US007654509B2

(12) United States Patent
Freitas et al.

(10) Patent No.: US 7,654,509 B2
(45) Date of Patent: Feb. 2, 2010

(54) DESUPERHEATER SPRAY NOZZLE

(75) Inventors: Stephen G. Freitas, Mission Viejo, CA (US); Ory D. Selzer, Irvine, CA (US); Raymond R. Newton, Trabuco Canyon, CA (US)

(73) Assignee: Control Components, Inc., Rancho Santa Margarita, CA (US)

( * ) Notice: Subject to any disclaimer, the term of this patent is extended or adjusted under 35 U.S.C. 154(b) by 0 days.

(21) Appl. No.: 12/118,615

(22) Filed: May 9, 2008

(65) Prior Publication Data

US 2009/0278266 A1 Nov. 12, 2009

(51) Int. Cl.
*B01F 3/04* (2006.01)
*B05B 15/06* (2006.01)

(52) U.S. Cl. ..... 261/62; 122/487; 137/542; 239/439; 251/84; 261/118; 261/DIG. 13

(58) Field of Classification Search ..... 261/62, 261/118, DIG. 13; 251/84; 239/439–441; 122/487; 137/542
See application file for complete search history.

(56) References Cited

U.S. PATENT DOCUMENTS 1,486,156 A 3/1924 Needham
1,893,298 A 1/1933 Moore
2,127,188 A 8/1938 Schellin et al.
2,155,986 A 4/1939 Wheaton
2,277,811 A 3/1942 Ashley et al.
2,313,994 A 3/1943 Grant
2,323,464 A 7/1943 Glessner
3,434,500 A * 3/1969 Burrows ..... 138/42
3,917,221 A * 11/1975 Kubota et al. ..... 251/127
4,512,520 A 4/1985 Schoonover
4,944,460 A 7/1990 Steingass
4,991,780 A 2/1991 Kannan et al.

(Continued)

FOREIGN PATENT DOCUMENTS

EP 1180627 A1 * 2/2002

(Continued)

OTHER PUBLICATIONS

Written Opinion of PCT/GB2007/003480.

*Primary Examiner*—Richard L Chiesa
(74) *Attorney, Agent, or Firm*—Stetina Brunda Garred & Brucker

(57) ABSTRACT

An improved valve element for a spray nozzle assembly of a steam desuperheating device that is configured to spray cooling water into a flow of superheated steam in a generally uniformly distributed spray pattern. The valve element includes a valve body and an elongate valve stem that is integrally attached to the valve body and extends axially therefrom. The valve body itself includes a nozzle cone which is integrally connected to the valve stem, and defines an outer surface. Integrally formed on a bottom surface of the nozzle cone is a hub having multiple ribs protruding therefrom. Integrally connected to each of the ribs is a generally circular fracture ring. The fracture ring is disposed in spaced relation to the lower edge of the nozzle cone which circumvents the bottom surface thereof. In this regard, a series of windows are formed in the valve body, with each window being framed by a segment of the lower edge of the nozzle cone, an adjacent pair of the ribs, and a segment of the top edge of the fracture ring.

20 Claims, 4 Drawing Sheets

U.S. PATENT DOCUMENTS

| | | | | |
|---|---|---|---|---|
| 6,619,568 | B2 | 9/2003 | Kunkle et al. | |
| 6,691,929 | B1 * | 2/2004 | Sherikar | 239/132.3 |
| 6,746,001 | B1 | 6/2004 | Sherikar | |
| 7,028,994 | B2 | 4/2006 | Sherikar | |
| 7,172,175 | B2 * | 2/2007 | Vicars | 251/324 |
| 2005/0194702 | A1 * | 9/2005 | Sherikar | 261/62 |
| 2006/0125126 | A1 | 6/2006 | Sherikar et al. | |

FOREIGN PATENT DOCUMENTS

| | | | |
|---|---|---|---|
| WO | WO 01/84029 | A1 * | 11/2001 |
| WO | WO 2004/106792 | A1 * | 12/2004 |

* cited by examiner

DESUPERHEATER SPRAY NOZZLE

CROSS-REFERENCE TO RELATED APPLICATIONS

Not Applicable

STATEMENT RE: FEDERALLY SPONSORED RESEARCH/DEVELOPMENT

Not Applicable

BACKGROUND OF THE INVENTION

1. Field of the Invention

The present invention pertains generally to steam desuperheaters and, more particularly, to a uniquely configured valve element for use in a spray nozzle assembly for a steam desuperheating device. The nozzle assembly is specifically adapted for creating a substantially uniformly distributed spray of cooling water for spraying into a flow of superheated steam in order to reduce the temperature thereof.

2. Description of the Related Art

Many industrial facilities operate with superheated steam that has a higher temperature than its saturation temperature at a given pressure. Because superheated steam can damage turbines or other downstream components, it is necessary to control the temperature of the steam. Desuperheating refers to the process of reducing the temperature of the superheated steam to a lower temperature, permitting operation of the system as intended, ensuring system protection, and correcting for unintentional deviations from a prescribed operating temperature set point.

A steam desuperheater can lower the temperature of superheated steam by spraying cooling water into a flow of superheated steam that is passing through a steam pipe. Once the cooling water is sprayed into the flow of superheated steam, the cooling water mixes with the superheated steam and evaporates, drawing thermal energy from the steam and lowering its temperature. If the cooling water is sprayed into the superheated steam pipe as very fine water droplets or mist, then the mixing of the cooling water with the superheated steam is more uniform through the steam flow.

On the other hand, if the cooling water is sprayed into the superheated steam pipe in a streaming pattern, then the evaporation of the cooling water is greatly diminished. In addition, a streaming spray of cooling water will pass through the superheated steam flow and impact the opposite side of the steam pipe, resulting in water buildup. This water buildup can cause erosion and thermal stresses in the steam pipe that may lead to structural failure. However, if the surface area of the cooling water spray that is exposed to the superheated steam is large, which is an intended consequence of very fine droplet size, the effectiveness of the evaporation is greatly increased.

In addition, the mixing of the cooling water with the superheated steam can be enhanced by spraying the cooling water into the steam pipe in a uniform geometrical flow pattern such that the effects of the cooling water are uniformly distributed throughout the steam flow. Conversely, a non-uniform spray pattern of cooling water will result in an uneven and poorly controlled temperature reduction throughout the flow of the superheated steam. Along these lines, the inability of the cooling water spray to efficiently evaporate in the superheated steam flow may also result in an accumulation of cooling water within the steam pipe. The accumulation of this cooling water will eventually evaporate in a non-uniform heat exchange between the water and the superheated steam, resulting in a poorly controlled temperature reduction.

Various desuperheater devices have been developed in the prior art in an attempt to address the aforementioned needs. Such prior art devices include those which are disclosed in U.S. Pat. Nos. 6,746,001 (entitled Desuperheater Nozzle) and 7,028,994 (entitled Pressure Blast Pre-Filming Spray Nozzle), and U.S. Patent Publication No. 2006/0125126 (entitled Pressure Blast Pre-Filming Spray Nozzle), the disclosures of which are incorporated herein by reference. The present inventions represent an improvement over these and other prior art solutions, and provides a desuperheater device for spraying cooling water into a flow of superheated steam that is of simple construction with relatively few components and that requires a minimal amount of maintenance, is capable of spraying cooling water in a fine mist with very small droplets for more effective evaporation within the flow of superheated steam, and is capable of spraying cooling water in a geometrically uniform flow pattern for more even mixing throughout the flow of superheated steam. Various novel features of the present invention will be discussed in more detail below.

BRIEF SUMMARY OF THE INVENTION

In accordance with the present invention, there is provided an improved valve element for a spray nozzle assembly of a steam desuperheating device that is configured to spray cooling water into a flow of superheated steam in a generally uniformly distributed spray pattern.

The nozzle assembly is comprised of a nozzle housing and a valve element which is movably interfaced to the nozzle housing. The valve element, also commonly referred to as a valve pintle or a valve plug, extends through the nozzle housing and is axially slidable between a closed position and an open (flow) position. The nozzle housing has a housing inlet and a housing outlet. The housing inlet is located at an upper portion of the nozzle housing. The housing outlet is located at a lower portion of the nozzle housing. The upper portion of the nozzle housing defines a housing chamber for receiving cooling water from the housing inlet. The lower portion of the nozzle housing defines a pre-valve gallery that is separated from the housing chamber by an intermediate portion of the nozzle housing. A valve stem bore is axially formed through the intermediate portion.

A plurality of housing passages are formed in the intermediate portion to fluidly interconnect the housing chamber (i.e. the housing inlet) with the pre-valve gallery (i.e. the housing outlet) such that cooling water may enter the housing inlet, flow into the housing chamber, through the housing passages, and into the pre-valve gallery before exiting the housing assembly at the housing outlet when the valve element is displaced or actuated to the open position.

The valve element comprises a valve body and an elongate valve stem that is integrally attached to the valve body and extends axially therefrom. The valve stem extends axially from the valve body and is advanced through the valve stem bore of the nozzle housing and is sized and configured to provide an axially sliding fit within the valve stem bore such that the valve element may be reciprocated between the open and closed positions. The lower portion of the nozzle housing includes a valve seat formed thereabout for sealing engagement with the valve body. The valve seat is preferably configured to be complementary to the valve body.

In one embodiment of the present invention, the valve body itself comprises a nozzle cone which is integrally connected to the valve stem, and defines an outer surface which is specifically shaped to have a curved, elliptical profile. Integrally formed on a bottom surface of the nozzle cone is a generally quadrangular hub having four ribs protruding from respective ones of four corner regions defined thereby. Integrally connected to each of the ribs is a generally circular fracture ring. The outer ends of the ribs are continuous with both the outer surface of the nozzle cone and the outer surface of the fracture ring, with the outer surfaces of the nozzle cone, the ribs and the fracture ring collectively defining a tapered profile for the valve body.

In the valve body, the fracture ring is disposed in spaced relation to the lower edge of the nozzle cone which circumvents the bottom surface thereof. In this regard, a series of windows are formed in the valve body, with each window being framed by a segment of the lower edge of the nozzle cone, an adjacent pair of the ribs, and a segment of the top edge of the fracture ring. The edges of the windows are sharp to cut the sheet flow leaving the outer surface of the nozzle cone, with the sharp edges being important to reducing droplet sizes from the valve element and hence the nozzle assembly.

The fracture ring of the valve body has a delta wedge cross-sectional configuration, with the apex of such wedge preferably intersecting the tangent line from the lower edge of the nozzle cone. Similarly, each of the ribs preferably has a delta wedge cross-sectional configuration, with the apex of the ribs continuing inwardly toward the axis of the valve element until the ribs are ultimately connected to the hub formed on the bottom surface of the nozzle cone. The integral connection of the ribs to the hub and thus the nozzle cone significantly improves the mechanical strength of the ribs and the fracture ring integrally connected to the ribs. The internal surfaces of the valve body defined by the ribs, fracture ring, hub and nozzle cone have no square corners or intersections, the elimination of which prevents the formation of streaks in the sheet flow leaving the valve element. Those of ordinary skill in the art will appreciate that the generation of such streaks in turn creates undesirable large droplets at lower nozzle flow rates.

In accordance with another embodiment of the valve element of the present invention, the outer end surface of each of the ribs may be stepped relative to the lower edge of the nozzle cone. This is in contrast to the aforementioned embodiment which is an in-line profile wherein the outer surface of the fracture ring, the outer surfaces of the ribs, and the outer surface of the nozzle cone are substantially flush or continuous with each other as indicated above. With the stepped profile, the outer surfaces of the fracture ring and ribs, while being substantially flush or continuous with each other, are at a slightly acute angle relative to the outer surface of the nozzle cone, and thus intersect the nozzle cone at a step beneath the same. The purpose of the stepped profile is to generate a detached sheet flow at lower flow rates. The sheet flow is split at the fracture ring, with the differential angle diverting a portion of the flow outward radially, thus increasing the cone area of the spray. In contrast, with the in-line profile, the tangent or continuous outer surfaces of the fracture ring, ribs and nozzle cone minimize disruption to the sheet flow, especially at low nozzle flow rates.

In accordance with yet another embodiment of the valve element of the present invention, the fracture ring is separated from the nozzle cone by a continuous gap or channel. In this particular embodiment, the ribs are integrally connected to a generally circular hub portion which is integrally connected to the bottom surface of the nozzle cone.

Despite the somewhat complex geometries of the valve elements constructed in accordance with the present invention, such valve elements can be manufactured quite simply. The internal tapered profiles and curved elliptical paths of the profiles are generated by machining the valve body with a simple tapered profile tool on a CNC machine. This represents a significant improvement over prior art valve element designs which are often too difficult to manufacture without compromising performance and strength.

In each embodiment of the valve element of the present invention, a portion of the outer surface of the nozzle cone is configured to be complimentary to the valve seat of the nozzle assembly such that the engagement of the outer surface of the nozzle cone to valve seat defined by the lower portion of the nozzle housing effectively blocks the flow of cooling water out of the nozzle assembly when the valve element is in the closed position. Conversely, when the valve element is axially moved from the closed position to the open position, cooling water is able to flow downwardly through an annular gap collectively defined by the outer surface of the nozzle cone and the valve seat. The combination of the conical valve seat and conical outer surface is effective to induce a conical spray pattern for the cooling water that is exiting the annular gap when the valve element is in the open position. As the film of cooling water flows downwardly over the outer surface of the nozzle cone of the valve body, a portion of the cooling water sheet impinges the fracture ring, with all of the cooling water eventually entering into the flow of super heated steam passing through the steam pipe.

As a result of the structural and functional attributes of the valve elements constructed in accordance with each embodiment of the present invention, cooling water droplet size is kept to a minimum, thus improving the absorption and evaporation efficiency of the cooling water within the flow of superheated steam, in addition to improving the spatial distribution of the cooling water. In this regard, the structural and functional attributes of the valve elements constructed in accordance with the present invention are operative to induce a conical spray pattern for the coolant water that is generated from the spray nozzle assembly when the valve element is in the open position, with the passage of a portion of the cooling water sheet over the fracture ring providing the desirable lower droplet size attributes describes above.

The present invention is best understood by reference to the following detailed description when read in conjunction with the accompanying drawings.

BRIEF DESCRIPTION OF THE DRAWINGS

These, as well as other features of the present invention, will become more apparent upon reference to the drawings wherein.

Common reference numerals are used throughout the drawings and detailed description to indicate like elements.

DETAILED DESCRIPTION OF THE INVENTION

Figure 1:
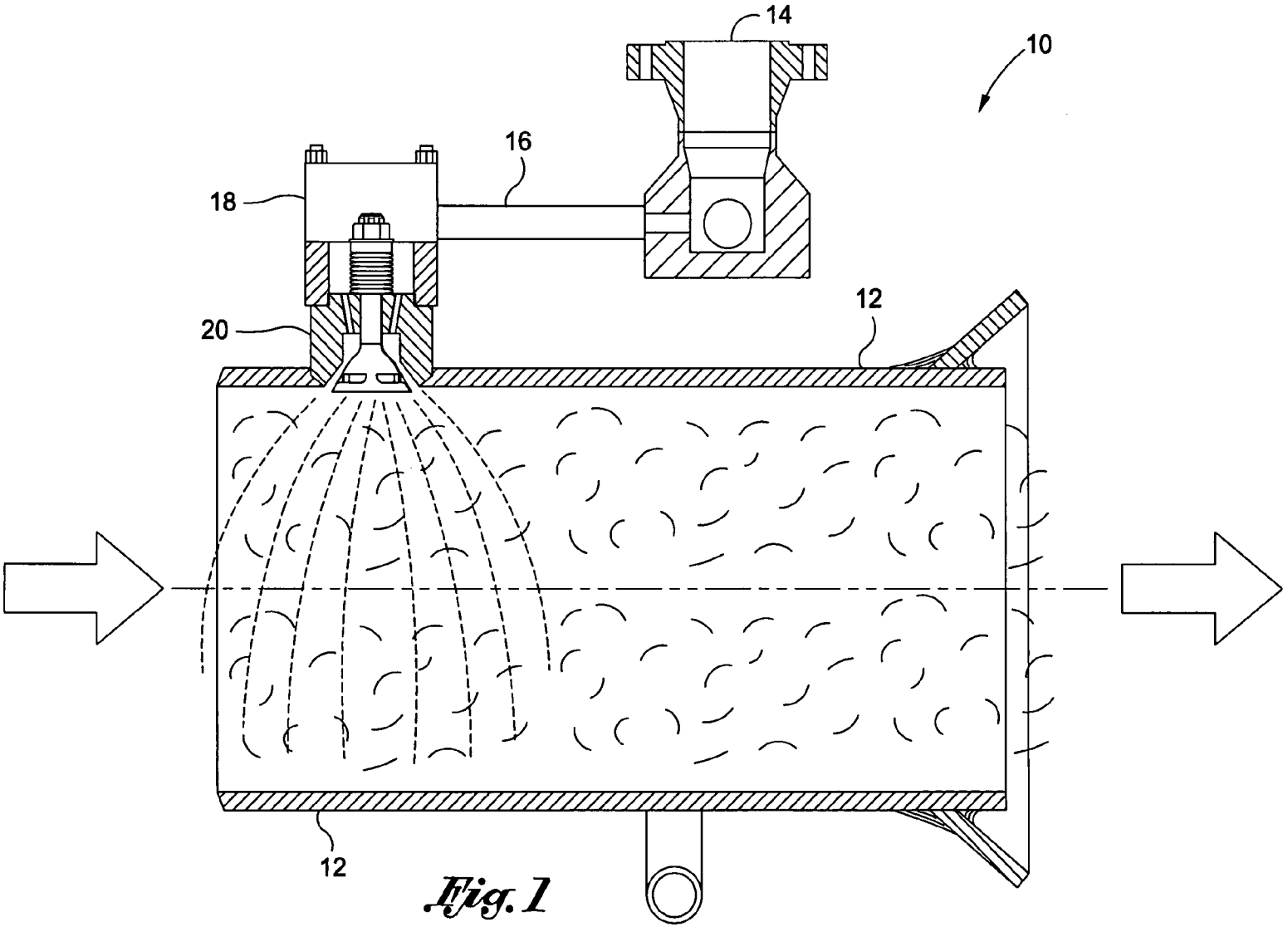
FIG. 1 is a longitudinal cross-sectional view of a desuperheater device incorporating a nozzle assembly having a valve element constructed in accordance with a first embodiment of the present invention.

Referring now to the drawings wherein the showings are for purposes of illustrating preferred embodiments of the present invention only, and not for purposes of limiting the same, FIG. 1 depicts an exemplary desuperheating device 10 that incorporates an improved valve pintle or valve element 78 within a nozzle assembly 20. The valve element 78 extends through the nozzle assembly 20 and is axially slidable between a closed position and an open position. As can be seen in FIG. 1, a flow of superheated steam at elevated pressure passes through a steam pipe 12 to which the nozzle assembly 20 may be attached by suitable means such as by welding and the like. A nozzle holder 18 joins a cooling water feed line 16 to the nozzle assembly 20 for providing a suitable supply of cooling water thereto.

The cooling water feed line 16 is connected to a cooling water control valve 14. The cooling water control valve 14 may be fluidly connected to a high pressure water supply (not shown). The control valve 14 is operative to control the flow of cooling water into the cooling water feedline 16 in response to a temperature sensor (not shown) mounted in the steam pipe 12 downstream of the nozzle assembly 20. The control valve 14 may vary the flow through the cooling water feedline 16 in order to produce varying water pressure in the nozzle assembly 20.

When the cooling water pressure in the nozzle assembly 20 is greater than the elevated pressure of the superheated steam in the steam pipe 12, the nozzle assembly 20 provides a spray of cooling water into the steam pipe 12. Although FIG. 1 shows a single nozzle assembly 20 connected to the steam pipe 12, it is contemplated that there may be any number of nozzle assemblies 20 spaced around the circumference of the steam pipe 12 for optimizing the efficiency of the desuperheater device 10. Each nozzle assembly 20 may be connected via the cooling water feed line 16 to a manifold (not shown) encircling the steam pipe 12 and connected to the cooling water control valve 14. As will be described below, the valve element 78 of the nozzle assembly 20 is specifically adapted for creating a substantially uniformly distributed spray of cooling water for spraying into the flow of superheated steam in order to reduce the temperature thereof.

Figure 2B:
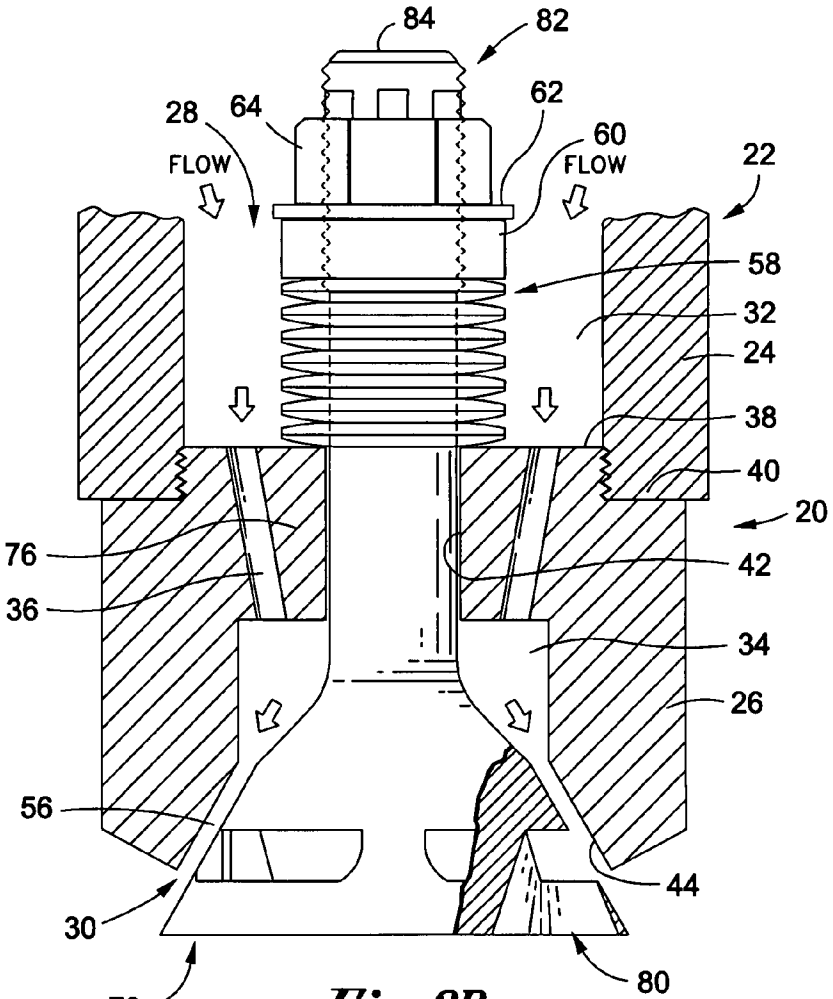
FIG. 2*b* is a longitudinal cross-sectional view of the nozzle assembly of FIG. 1 illustrating the valve element of the first embodiment in an open position.
Figure 2A:
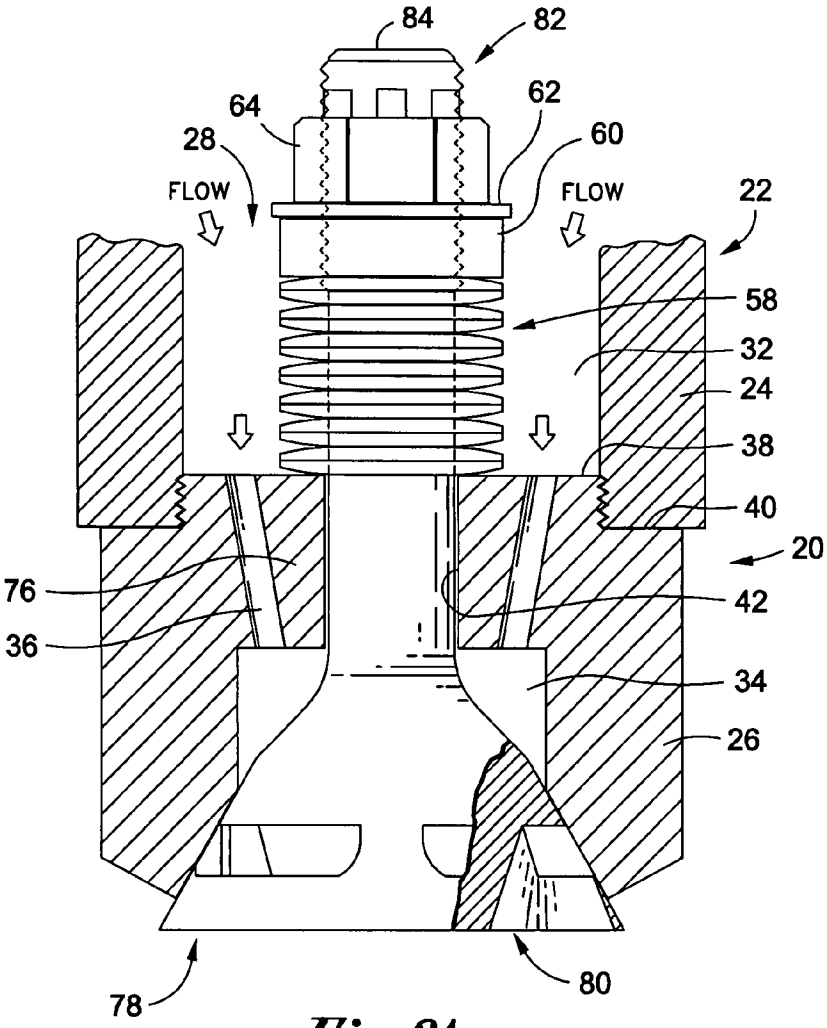
FIG. 2*a* is a longitudinal cross-sectional view of the nozzle assembly of FIG. 1 illustrating the valve element of the first embodiment in a closed position.

Turning now to FIGS. 2A and 2B, shown is a sectional view of the nozzle assembly 20 of the desuperheating device 10 of FIG. 1. In FIGS. 2A and 2B, the nozzle assembly 20 is comprised of a nozzle housing 22 and the valve element 78 as constructed in accordance with a first embodiment of the present invention. The valve element 78 of the first embodiment is also shown in FIGS. 3-6. The specific configuration and features of the valve element 78 will be described in greater detail below. The nozzle assembly 20 is shown in FIG. 2A with the valve element 78 disposed in a closed position. FIG. 2B illustrates the valve element 78 disposed in an open position. The nozzle housing 22 has a housing inlet 28 and a housing outlet 30. The housing inlet 28 is located at an upper portion 24 of the nozzle housing 22. The housing outlet 30 is located at a lower portion 26 of the nozzle housing 22. The upper and lower portions 24, 26 may be integrated into a unitary structure.

Figure 7:
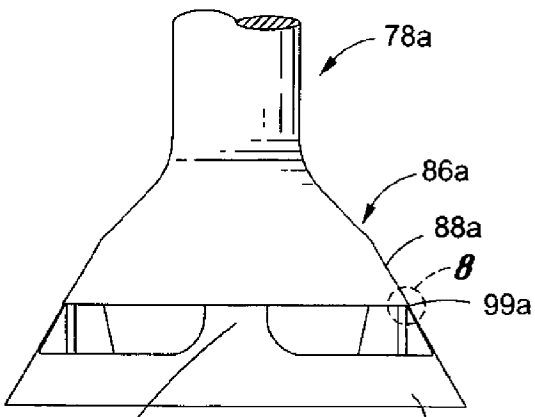
FIG. 7 is a side elevational view of a valve element constructed in accordance with a second embodiment of the present invention.
Figure 8:
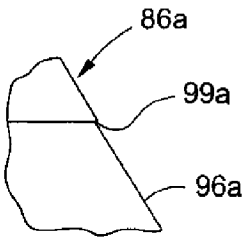
FIG. 8 is an enlargement of the encircled region 8 shown in FIG. 7.

Alternatively, the nozzle housing 22 may be fabricated as two separate components comprising the upper portion 24 and the lower portion 26 as is shown in FIGS. 2A and 2B. The upper portion 24 may be threadably attached to the lower portion 26 at an abutment 40 therebetween such that the valve element 78 and the lower portion 26 may be removed from the upper portion 24 and replaced with a valve element 78 and lower portion 26 of the same configuration or of an alternative configuration. Thus, it is contemplated that the valve element 78 may be interchangeable wherein an alternative embodiment of the valve element 78 may be substituted for the first embodiment. In this regard, FIGS. 7 and 8 illustrate a valve element 78*a* constructed in accordance with a second embodiment of the present invention. FIGS. 9-13 illustrate a valve element 106 constructed in accordance with a third embodiment of the present invention. The specific configurations and features of the second and third embodiments of the valve element 78 will also be described in greater detail below.

Referring still to FIG. 2A, the upper portion 24 of the nozzle housing 22 may define a housing chamber 32 for receiving cooling water from the housing inlet 28. The lower portion 26 of the nozzle housing 22 may define a pre-valve gallery 34 that is separated from the housing chamber 32 by an intermediate portion 76 of the nozzle housing 22. Both the housing chamber 32 and the pre-valve gallery 34 may be annularly shaped. A valve stem bore 42 may be axially formed through the intermediate portion 76 of the nozzle housing 22. A plurality of housing passages 36 are formed in the intermediate portion 76 to fluidly interconnect the housing chamber 32 (i.e. the housing inlet 28) with the pre-valve gallery 34 (i.e. the housing outlet 30) such that cooling water may flow from the housing inlet 28, into the housing chamber 32, through the housing passages 36, and into the pre-valve gallery 34 before exiting the nozzle assembly 20 at the housing outlet 30 when the valve element 78 is displaced or actuated to the open position.

As seen in FIG. 2A, the housing passages 36 may be angled inwardly relative to the valve stem bore 42 along a direction from the housing inlet 28 to the housing outlet 30. Such inward angling of the housing passages 36 may permit a general reduction in the overall size of the nozzle assembly 20. In addition, such inward angling of the housing passages 36 may facilitate the formation of the substantially uniform spray pattern of cooling water that is discharging from the nozzle assembly 20. The housing passages 36 may be concentrically disposed around and equidistantly spaced about the valve stem bore 42. However, the housing passages 36 may be configured in any number of configurations. For example, the housing passages 36 may be configured with substantially equal circular cross-sectional shapes and may be axially aligned with the valve stem bore 42.

In addition, the housing passages 36 may be configured as a plurality of generally arcuately-shaped slots extending axially through the intermediate portion 76 in equidistantly spaced relation to each other. The housing passages 36 are spaced about the valve stem bore 42 in order to eliminate the tendency for the cooling water to exit the nozzle assembly 20 in a streaming spray pattern. In this regard, the combination of the housing passages 36 and the geometry of the valve element 78 are configured to cooperate in order to provide a geometrically uniform spray pattern of the cooling water into the steam pipe 12. Regardless of their specific geometric arrangement, size and shape, the housing passages 36 are configured to provide a flow of cooling water from the housing inlet 28 to the housing outlet 30 when the valve element 78 is moved to the open position, as will be described in greater detail below.

Having thus described the structural and functional attributes of the nozzle assembly 20, the specific functional and structural attributes of the valve element 78 thereof will now be discussed with specific reference to FIGS. 3-6. In particular, the valve element 78 comprises a valve body 80 and an elongate valve stem 82 which is integrally attached to the valve body 80 and extends axially therefrom. The valve stem 82 has a generally circular cross-sectional configuration, and defines a distal end 84. It is contemplated that a distal portion of the valve stem 82 extending to the distal end 84 thereof may be externally threaded for purposes of facilitating the operative interface of the valve element 78 to the remainder of the nozzle assembly 20. The valve stem 82 is sized and configured to be slidably advanceable through the valve stem bore 42 of the nozzle housing 22. In this regard, the valve stem 82 may be sized and configured to be complimentary to the valve stem bore 42 such that an axially sliding fit is provided therebetween. This allows the valve stem 82, and hence the valve element 78, to be reciprocated within the valve stem bore 42 such that the valve element 78 may be moved between its open and closed positions as will be described in greater detail below.

Figure 6:
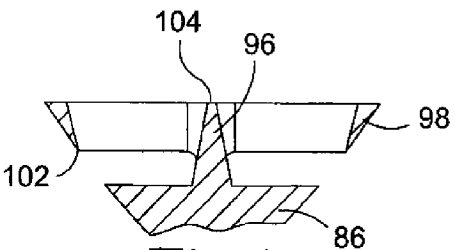
FIG. 6 is a partial cross-sectional view of the valve element of the first embodiment taken along line 6-6 of FIG. 4.
Figure 3:
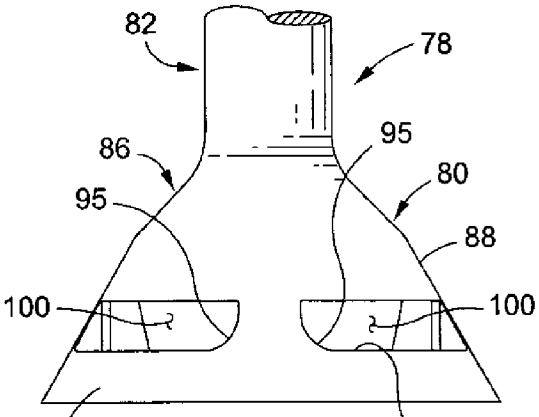
FIG. 3 is a side elevational view of the valve element of the first embodiment.

The valve body 80 of the valve element 78 itself comprises a nozzle cone 86 which is integrally connected to the valve stem 82 and defines a conical outer surface 88 which is specifically shaped to have a curved, elliptical profile as it extends along the axis of the valve element 78. In addition to the outer surface 88, the nozzle cone 86 defines a bottom surface 90 circumvented by a generally circular, peripheral lower edge 92. Integrally formed on the bottom surface 90 of the nozzle cone 86 is a generally quadrangular hub 94. Integrally connected to the hub 94 is a plurality of (e.g., four) ribs 96 which protrude from respective ones of the four corner regions defined by the hub 94. As seen in FIG. 6, the ribs 96 are also integrally connected to the bottom surface 90 of the nozzle cone 86. Integrally connected to each of the ribs 96 is a generally circular or annular fracture ring 98 which is disposed in spaced relation to the nozzle cone 86, and in particular the lower edge 92 thereof. In the valve body 80, the outer ends or outer end surfaces of the ribs 96 are substantially flush or continuous with the outer surface 88 of the nozzle cone 86 as well as the outer surface of the fracture ring 98, as is best seen in FIG. 3. As a result, the outer surface 88 of the nozzle cone 86, the outer end surfaces of the ribs 96, and the outer surface of the fracture ring 98 collectively define a tapered profile for the valve body 80.

Figure 5:
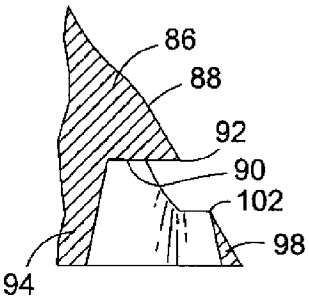
FIG. 5 is a partial cross-sectional view of the valve element of the first embodiment taken along line 5-5 of FIG. 4.

In the valve element 78, the fracture ring 98 of the valve body 80 is disposed in spaced relation to the peripheral lower edge 92 of the nozzle cone 86 which, as indicated above, circumvents the bottom surface 90 thereof. The fracture ring 98 also preferably has a delta wedge cross-sectional configuration as shown in FIG. 5, with the apex of such wedge defining the leading edge or the top edge 102 of the fracture ring 98, such top edge 102 preferably intersecting the tangent line from the lower edge 92 of the nozzle cone 86. Similarly, as best seen in FIG. 6, each of the ribs 96 preferably has a delta wedge cross-sectional configuration, with the apex of each rib 96 defining the bottom edge 104 thereof which is directed away from the nozzle cone 86. In the valve element 78, the apex or bottom edge 104 of each of the ribs 98 continues inwardly toward the axis of the valve element 78 until the ribs 96 are ultimately connected to the above-described hub 94 formed on the bottom surface 90 of the nozzle cone 86.

As indicated above, in the valve body 80, the fracture ring 98 is disposed in spaced relation to the lower edge 92 of the nozzle cone 86. As a result, a plurality of (e.g., four) windows 100 are formed in the valve body 80, with each window 100 being framed by a segment of the lower edge 92 of the nozzle cone 86, an adjacent pair of the ribs 96, and a segment of the top edge 102 of the fracture ring 98. The edges of the windows 100, and in particular the top edge 102 of the fracture ring 98, are sharp to cut the sheet flow leaving the outer surface 88 of the nozzle cone 86, with the sharp edges being important to reducing droplet sizes from the valve element 78 and hence the nozzle assembly 20.

Figure 4:
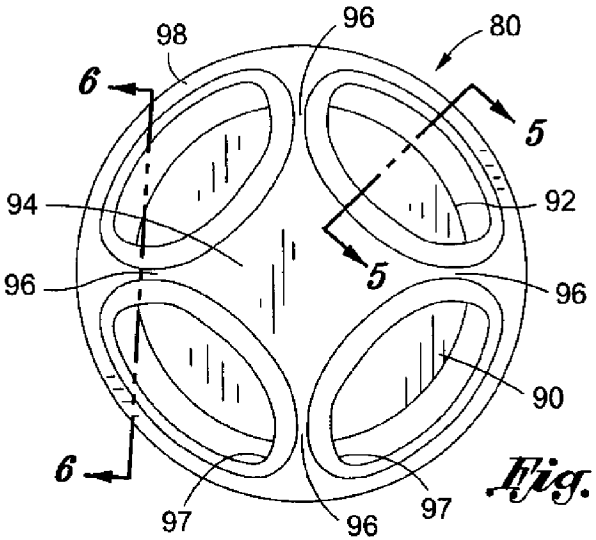
FIG. 4 is a bottom plan view of the valve element of the first embodiment.

In the valve element 78, the integral connection of the ribs 96 to the hub 94 and the nozzle cone 86 significantly improves the mechanical strength of the ribs 96 and the fracture ring 98 integrally connected to the ribs 96. Additionally, the internal surfaces of the valve body 80 defined by the ribs 96, fracture ring 98, hub 94 and nozzle cone 86 are each preferably formed such that cooling water flowing over the valve element 78 is not exposed to any square corners or intersections, the elimination of which prevents the formation of streaks in the sheet flow leaving the valve element 78. In this regard, as seen in FIG. 3, the transition between each of the ribs 96 and the top edge 102 of the fracture ring 98 is partially defined by an opposed pair of arcuate sections 95 of each of the ribs 96. As such, each of the windows 100 is partially defined by two arcuate sections 95 included on respective ones of an adjacent pair of the ribs 96. Further, as seen in FIG. 4, the transition between the opposed side surfaces of each of the ribs 96 and the inner surface of the fracture ring 98 is defined by an opposed pair of arcuate sections 97 of each of the ribs 96. As indicated above, the rounded corners created by the arcuate sections 95, 97 of the ribs 96 is instrumental in the reduction or elimination of streaks in the sheet flow leaving the valve element 78.

As indicated above, the valve stem 82 is slidably advanced through the valve stem bore 42 and operatively coupled to the nozzle housing 22 so as to allow the valve element 78 to be reciprocally moveable between its open and closed positions. In the nozzle assembly 20, the lower portion 26 of the nozzle housing 22 at the housing outlet 30 defines an annular valve seat 44 which is adapted for sealing engagement with the valve body 80, and in particular a portion of the outer surface 88 of the nozzle cone 86 thereof. The valve seat 44 is typically angled into a generally conical configuration, as is shown in FIGS. 2A and 2B. Preferably, the outer surface 88 of the nozzle cone 86 in the valve body 80 is sized and configured to be complimentary to the valve seat 44 such that the engagement of the outer surface 88 to the valve seat 44 effectively blocks the flow of cooling water outer of the nozzle assembly 20 when the valve element 78 is in the closed position. Conversely, when the valve element 78 is axially moved from the closed position to the open position, cooling water is able to flow downwardly through an annular gap 56 collectively defined by the outer surface 88 of the nozzle cone 86 and the valve seat 44 in the manner shown in FIG. 2B.

Preferably, the outer surface 88 of the nozzle cone 86 of the valve body 80 is configured such that its half angle differs from a half angle of the valve seat 44. More specifically, the half angle of the outer surface 88 is preferably configured to be less than or greater than the half angle of the valve seat 44. Additionally, the half angle of the outer surface 88 and the half angle of the valve seat 44 are preferably between about 20 degrees and about 60 degrees. Further, as seen in FIG. 2A, the size and configuration of the valve element 78 relative to the nozzle housing 22 is such that the peripheral edge 92 of the nozzle cone 86, the windows 100, ribs 96 and fracture ring 98 are each disposed outboard of the lower portion 26 of the nozzle housing 20 even when the valve element 78 is in its closed position.

When the valve element 78 is actuated to its open position as shown in FIG. 2B, the combination of the conical valve seat 44 and the conical outer surface 88 of the nozzle cone 86 is effective to induce a conical spray pattern for the cooling water that is exiting the annular gap 56. As the film of cooling water flows along the outer surface 88 of the nozzle cone 86 of the valve body 80, the gradually increasing diameter of the nozzle cone 86 attributable to its conical shape is operative to gradually reduce the sheet thickness of the cooling water, thus facilitating an initial reduction of the droplet size in the conical spray pattern. Additionally, the spacing between the fracture ring 98 and the nozzle cone 86 serves to temporarily detach at least a portion of the conical spray pattern or sheet of the cooling water from the valve element 78. When the conical spray pattern or sheet impacts with the top edge 102 of the fracture ring 98, the top edge 102 of the fracture ring 98 splits the conical sheet of cooling water, thus providing a second stage of atomization. The functionality of the fracture ring 98 is based on the Lefavre principle which holds that the droplet size of the cooling water is proportional to the sheet thickness of the cooling water after it passes over the valve element 78. After the droplet size of the cooling water is effectively reduced by the impact the cooling water sheet against the top edge 102 of the fracture ring 98, the cooling water enters into the flow of superheated steam passing through the steam pipe 12. Advantageously, the structural and functional attributes of the valve element 78 effectively reduce cooling water droplet size to a minimum, thus improving the absorption and evaporation efficiency of the cooling water within the flow of superheated steam, in addition to improving the spatial distribution of the cooling water.

Referring back to FIGS. 2A and 2B, the nozzle assembly 20 may also include at least one valve spring 58 which is operatively coupled to the valve element 78 for biasing the valve element 78 into sealing engagement against the valve seat 44. The valve spring 58 abuts a housing shoulder 38 of the nozzle housing 22 and biases the valve body 80 into sealed engagement against the valve seat 44. It is contemplated that the biasing force may be provided by at least one pair of belleville washers slidably mounted on the valve stem 82 in a back-to-back arrangement. Additionally, although shown as belleville washers, it should be noted that the valve spring 58 may be configured in a variety of alternative configurations. A spacer 60 may also be included in the nozzle assembly 20, with the spacer 60 being mounted on the valve stem 82 in abutment with the valve spring 58. The spacer 60 shown in FIGS. 2A and 2B has a generally cylindrical configuration. The thickness of the spacer 60 may be selectively adjustable to limit the compression characteristics of the valve element 78 within the nozzle housing 22 such that the point at which the valve element 78 is moved from the closed position to the open position may be adjustable. In this regard, it is contemplated that for a given configuration of the nozzle assembly 20, spacers 60 of various thicknesses may be substituted to provide some degree of controllability regarding the axial movement of the valve element 78, and ultimately, the size of the annular gap 56 when the valve element 78 is in the open position.

Also included in the nozzle assembly 20 is a valve stop 62 mounted on the valve stem 82 of the valve element 78. The valve stop 62 may be configured to extend beyond the diameter of the spacer 60 for configurations of the nozzle housing 22 that include a spring bore (not shown) formed therethrough. In such configurations including a spring bore, the valve stop 62 may limit the axial movement of the valve element 78. In FIGS. 2A and 2B, the valve stop 62 is shown configured as a stop washer mounted on the valve stem 82 and disposed in abutting contact with the spacer 60. The stop washer may have a diameter greater than that of the spring bore (if included) for limiting the axial movement of the valve element 78 such that the size of the annular gap 56 may be limited.

As further shown in FIGS. 2A and 2B, the nozzle assembly 20 may also include a load nut 64 threadably attached to the externally threaded distal portion of the valve stem 82 described above. The load nut 64 may be adjusted to apply a spring preload to the valve spring 58 by moving the valve stem 82 and the spacer 60 axially relative to each other to compress the valve spring 58 between the spacer 60 and the housing shoulder 38. For configurations of the nozzle assembly 20 that do not include a spacer 60, the adjustment of the load nut 64 compresses the valve spring 58 between the housing shoulder 38 and the valve stop 62. For configurations of the nozzle assembly 20 that do not include the valve stop 62, the adjustment of the load nut 64 compresses the valve spring 58 between the load nut 64 and the housing shoulder 38 (or spring bore, if included). In any case, the load nut 64 may be adjusted to apply a compressive force to the valve body 80 against the valve seat 44. The load nut 64 is selectively adjustable to regulate the point at which the pressure of cooling water in the pre-valve gallery 34 against the valve body 80 overcomes the combined pressure of the spring preload and the elevated pressure of the superheated steam against the valve body 80. The spring preload is thus transferred to the valve body 80 against the valve seat 44. The amount of linear closing force exerted on the valve seat 44 by the valve spring 58 is adjusted by the axial position of the load nut 64 along the threaded portion of the valve stem 82. Though not shown, it is also contemplated that the nozzle assembly 20 may be outfitted with structural features which are adapted to interface with the valve element 78 in a manner holding the valve element 78 against rotation during adjustment of the load nut 64, and are further adapted to prevent rotation of the load nut 64 after adjustment.

In operation, a flow of superheated steam and elevated pressure passes through the steam pipe 12, to which the nozzle housing 22 is attached, as is shown in FIG. 1. The cooling water feed line 16 provides a supply of cooling water to the nozzle assembly 20. The control valve 14 varies the flow through the cooling water feed line 16 in order to control water pressure in the nozzle assembly 20. Cooling water exiting the cooling water feed line 16 passes into the housing chamber 32 adjacent the housing inlet 28. The cooling water flows through the housing passages 36 of the nozzle housing 22 and into the pre-valve gallery 34 adjacent the housing outlet 30. The housing passages 36 minimize or eliminate a tendency for the cooling water to exit the nozzle assembly 20 in a streaming spray. The cooling water in the pre-valve gallery 34 bears against the valve body 80 of the valve element 78 when the valve element 78 is in the closed position as shown in FIG. 2A.

As indicated above, the adjustment of the load nut 64 compresses the valve spring 58 to apply a compressive force to the valve body 80 against the valve seat 44. In this regard, the spring preload serves to initially hold the valve element 78 in the closed position, as shown in FIG. 2A. The amount of linear closing force exerted on the valve seat 44 by the valve spring 58 is adjusted by rotating the load nut 64 along the externally threaded portion of the valve stem 82. The load nut 64 is selectively adjustable to regulate the point at which the pressure of the cooling water in the pre-valve gallery 34 against the valve body 80 overcomes the combined pressure of the spring preload and the elevated pressure of the superheated steam acting against the interior surfaces of the valve element 78 defined by the valve body 80 thereof.

When the pressure of the cooling water against the valve body 80 overcomes the combined pressure of the spring preload and the elevated pressure of the superheated steam, the valve body 80 moves axially away from the valve seat 44, opening the annular gap 56 as shown in FIG. 2B. Cooling water can then flow through the annular gap 56 and into the steam pipe 12 containing the flow of superheated steam. When the control valve 14 increases the water flow through the cooling water feed line 16 in response to a signal from the temperature sensor, an increase in cooling water pressure against the valve body 80 occurs, forcing the valve body 80 axially further away from the valve seat 44 and further increasing the size of the annular gap 56. This in turn allows for a greater amount of cooling water to pass through the annular gap 56 and into the flow of superheated steam. For cooling water flowing along the conical outer surface 88 of the nozzle cone 86, the curved, elliptical profile of the outer surface 88 as described above creates a deflective angle which assists in optimizing the flow characteristics of the cooling water through the gap 56.

As explained above, as a result of the structural and functional attributes of the valve element 78, cooling water droplet sizes from the of the conical sheet passing over the valve element 78 are minimized, thus improving the absorption and evaporation efficiency of cooling water within the flow of superheated steam, in addition to improving the spatial distribution of the cooling water. In this regard, the cooling water enters the steam pipe 12 in a cone-shape pattern of a generally uniform fine mist spray pattern consisting of very small water droplets. The uniform mist spray pattern ensures a thorough and uniform mixing of the cooling water with the superheated steam flow. The uniform spray pattern also maximizes the surface area of the cooling water spray and thus enhances the evaporation rate of cooling water.

Referring now to FIGS. 7 and 8, there is shown a valve element 78*a* constructed in accordance with a second embodiment of the present invention. The valve element 78*a* is substantially similar in structure and function to the above-described valve element 78, with only the distinctions between the valve elements 78, 78*a* being highlighted below.

The sole distinction between the valve elements 78, 78*a* lies in the outer end surface of each of the ribs 96*a* in the valve element 78*a* being stepped relative to the lower edge 92*a* of he nozzle cone 86*a* thereof. This is in contrast to the valve element 78 which is an in-line profile wherein the outer surface of the fracture ring 98, the outer end surfaces of the ribs 96, and the outer surface 88 of the nozzle cone 86 are substantially flush or continuous with each other as indicated above. With the stepped profile, the outer surfaces of the fracture ring 98*a* and ribs 96*a*, while being substantially flush or continuous with each other, are at a slightly acute angle relative to the outer surface 88*a* of the nozzle cone 88 and thus intersect the nozzle cone 86*a* at a step 99*a* beneath the same as best shown in FIG. 8. The purpose of this stepped profile is to generate a detached sheet flow at lower flow rates. In this regard, in the valve element 78*a*, though the sheet flow is still split at the fracture ring 98*a*, the differential angle attributable to the step 99*a* diverts a portion of the flow radially outward, thus increasing the cone area of the spray. In contrast, with the in-line profile described above in relation to the valve element 78, the tangent or continuous outer surfaces of the fracture ring 98, ribs 96 and nozzle cone 86 minimize disruption to the sheet flow, especially at low nozzle flow rates.

Referring now to FIGS. 9-13, there is shown a valve element 106 constructed in accordance with a third embodiment of the present invention. The valve element 106 comprises a valve body 108 and an elongate valve stem 110 which is integrally attached to the valve body 108 and extends axially therefrom. The valve stem 110 has a generally circular cross-sectional configuration, and defines a distal end 112. It is contemplated that a distal portion of the valve stem 110 extending to the distal end 112 thereof may be externally threaded for purposes of facilitating the operative interface of the valve element 106 into the above-described nozzle assembly 20. The valve stem 110, like the valve stem 82 of the valve element 78, is sized and configured to be slidably advanceable through the valve stem bore 42 of the nozzle housing 22. In this regard, the valve stem 110 is sized and configured to be complimentary to the valve stem bore 42 such that an axially sliding fit is provided therebetween. This allows the valve stem 110, and hence the valve element 106, to be reciprocated within the valve stem bore 42 such that the valve element 106 may be moved between open and closed positions within the nozzle assembly 20.

The valve body 108 of the valve element 106 itself comprises a nozzle cone 114 which is integrally connected to the valve stem 110 and defines an outer surface 116 which is specifically shaped to have a curved, elliptical profile as it extends along the axis of the valve element 106. In addition to the outer surface 116, the nozzle cone 114 defines a bottom surface 118 circumvented by a generally circular, peripheral lower edge 120. Integrally formed on the bottom surface 118 of the nozzle cone 114 is a circular, generally cylindrical hub 122. Integrally connected to the hub 122 is a plurality of (e.g., four) ribs 124. The ribs 124 protrude radially outward from the hub 122 at equidistantly spaced intervals of approximately 90°. Integrally connected to the distal end of each of the ribs 124 is a generally circular or annular fracture ring 126.

Figures 9, 10, 11, 12, 13:
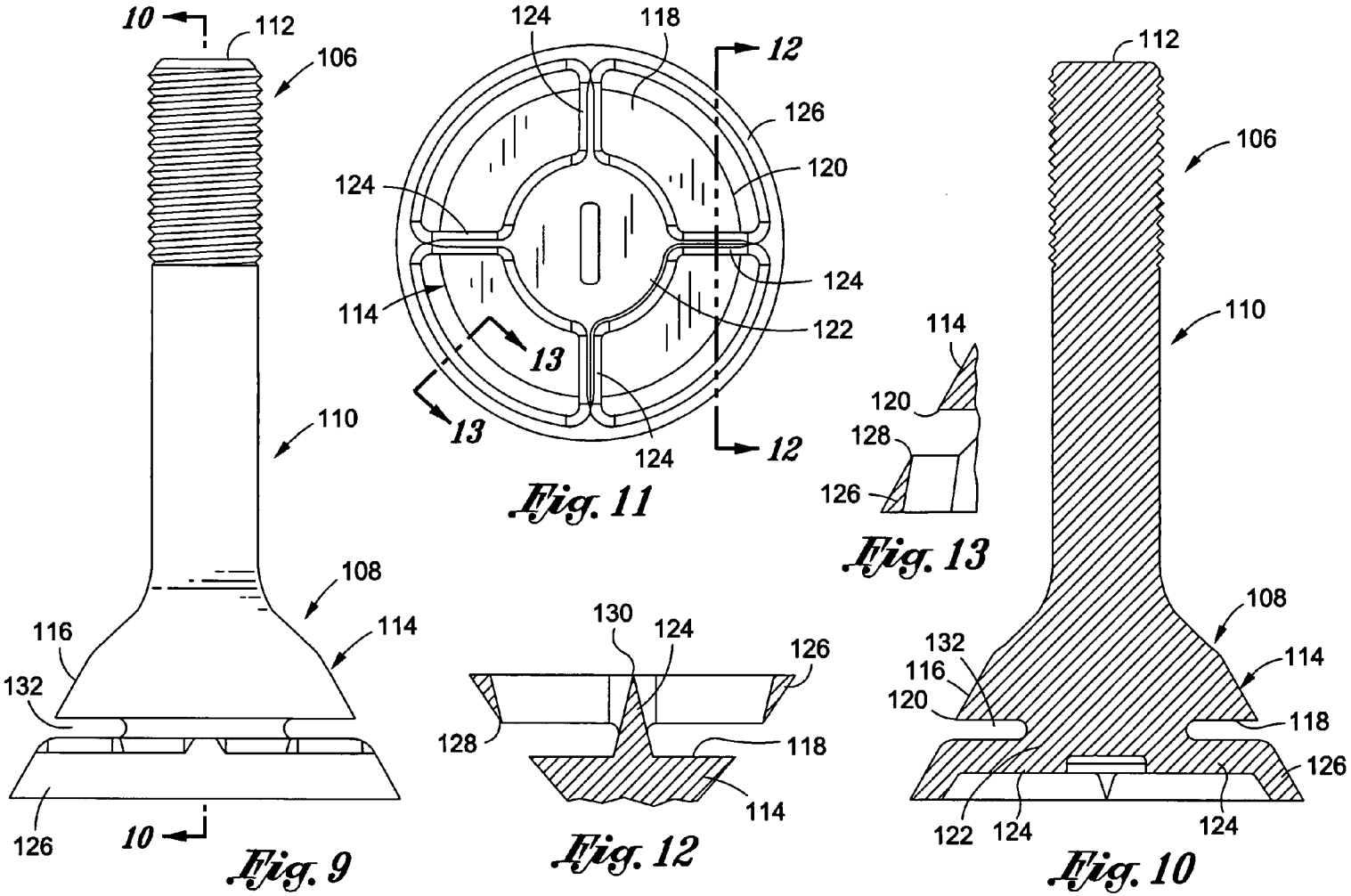
FIG. 9 is a side elevational view of a valve element constructed in accordance with a third embodiment of the present invention.
FIG. 10 is a cross-sectional view of the valve element of the third embodiment shown in FIG. 9.
FIG. 11 is a bottom plan view of the valve element of the third embodiment.
FIG. 12 is a partial cross-sectional view of the valve element of the third embodiment taken along line 12-12 of FIG. 11.
FIG. 13 is a partial cross-sectional view of the valve element of the third embodiment taken along line 13-13 of FIG. 11.

In the valve element 106, the fracture ring 126 of the valve body 108 is disposed in spaced relation to the peripheral lower edge 120 of the nozzle cone 114 which, as indicated above, circumvents the bottom surface 118 thereof. The fracture ring 126 also preferably has a delta wedge cross-sectional configuration as shown in FIGS. 12 and 13, with the apex of such wedge defining the top edge 128 of the fracture ring 126, such top edge 128 preferably intersecting the tangent line from the lower edge 120 of the nozzle cone 114. Similarly, as best seen in FIG. 12, each of the ribs 124 preferably has a delta wedge cross-sectional configuration, with the apex of each rib 124 defining the bottom edge 130 thereof which is directed away from the nozzle cone 114. In the valve element 106, the apex of bottom edge 130 of each of the ribs 124 continues inwardly toward the axis of the valve element 106, until the ribs 124 are ultimately connected to the above-described hub 122 formed on the bottom surface 118 of the nozzle cone 114.

In the valve body 108 of the valve element 106, the fracture ring 126 is disposed in spaced relation to the nozzle cone 114, and in particular the lower edge 120 thereof. As a result, a continuous channel or gap 132 is defined between the nozzle cone 114 and the fracture ring 126, and more particularly between the lower edge 120 of the nozzle cone 114 and the top edge 128 of the fracture ring 126. The top edge 128 of the fracture ring 126 is sharp to cut the sheet flow leaving the outer surface 116 of the nozzle cone 114, with such sharp edge being important to reducing droplet sizes from the valve element 106 if integrated into the nozzle assembly 20.

In the valve element 106, the integral connection of the ribs 124 to the hub 122 significantly improves the mechanical strength of the ribs 124 and the fracture ring 126 integrally connected to the ribs 124. Additionally, the internal surfaces of the valve body 108 defined by the ribs 124, fracture ring 126, hub 122 and nozzle cone 114 are each preferably formed such that cooling water flowing over the valve element 106 is not exposed to any square corners or intersections, the elimination of which assists in preventing the formation of streaks in the sheet flow leaving the valve element 106.

The operative attachment of the valve element 106 to the remainder of the nozzle assembly 20 occurs in the same manner described above in relation to the interface of the valve element 78 into the remainder of the nozzle assembly 20. The outer surface 116 of the nozzle cone 114 is further configured such that its half angle differs from the half angle of the valve seat 44 as needed to facilitate the prescribed sealed engagement between the valve element 106 and the nozzle housing 22 when the valve element 106 is in the closed position. If the valve element 106 is substituted for the valve element 78 and actuated to the open position similar to that shown in FIG. 2B, the combination of the conical valve seat 44 and the conical outer surface 116 of the nozzle cone 114 is effective to induce a conical spray pattern for the cooling water that is exiting the annular gap 56. As the film of cooling water flows along the outer surface 116 of the nozzle cone 114 of the valve body 108, the gradually increasing diameter of the nozzle cone 114 attributable to its conical shape is operative to gradually reduce the sheet thickness of the cooling water, thus facilitating an initial reduction of the droplet size in the conical spray pattern. Additionally, the spacing between the fracture ring 126 and the nozzle cone 114 serves to temporarily detach the conical spray pattern or sheet of the cooling water from the valve element 106. When the conical spray pattern or sheet impacts with the top edge 128 of the fracture ring 126, the top edge 128 of the fracture ring 126 splits the conical sheet of cooling water, thus providing a second stage of atomization similar to that described in relation to the valve element 78. Thus, the structural and functional attributes of the valve element 106 effectively reduce cooling water droplet size to a minimum, thus improving the absorption and evaporation efficiency of the cooling water within the flow of superheated steam, in addition to improving the spatial distribution of the cooling water.

This disclosure provides exemplary embodiments of the present invention. The scope of the present invention is not limited by these exemplary embodiments. Numerous variations, whether explicitly provided for by the specification or implied by the specification, such as variations in structure, dimension, type of material and manufacturing process may be implemented by one of skill in the art in view of this disclosure.

What is claimed is:

1. A valve element for integration into a nozzle assembly, the valve element comprising:

a generally conical valve body; and an elongate valve stem integrally connected to and extending axially from the valve body along a valve element axis;

wherein the valve body comprises:

a nozzle cone defining an outer surface and a bottom surface which is circumvented by a peripheral lower edge, the outer surface having a generally elliptical profile as it extends from the valve stem toward the lower edge;

a hub integrally connected to the bottom surface of the nozzle cone;

at least one rib integrally connected to the hub; and a fracture ring integrally connected to the rib and disposed in spaced relation to the nozzle cone.

2. The valve element of claim 1 wherein the at least one rib comprises a plurality of ribs integrally connected to the hub, the fracture ring being integrally connected to each of the ribs.

3. The valve element of claim 2 wherein the hub has a generally quadrangular configuration, and four ribs are integrally connected to and protrude from respective ones of four corner regions defined by the hub.

4. The valve element of claim 2 wherein the hub has a generally cylindrical configuration, and four ribs are integrally connected to and extend radially outward from the hub.

5. The valve element of claim 4 wherein the ribs are arranged at equidistantly spaced intervals of approximately 90°.

6. The valve element of claim 2 wherein each of the ribs is further integrally connected to the bottom surface of the nozzle cone.

7. The valve element of claim 2 wherein each of the ribs has a generally wedge-shaped cross-sectional configuration and defines a lower apex which is directed away from the nozzle cone.

8. The valve element of claim 2 wherein each of the ribs defines an outer end surface which is substantially continuous with the outer surface of the nozzle cone.

9. The valve element of claim 8 wherein the outer end surface of each of the ribs is separated from the lower edge of the nozzle cone by a step which is defined by a peripheral portion of the bottom surface of the nozzle cone.

10. The valve element of claim 8 wherein the fracture ring defines an outer surface which is substantially flush with the outer end surface of each of the ribs.

11. The valve element of claim 1 wherein the fracture ring has a generally wedge-shaped cross-sectional configuration and defines an upper apex which is directed toward and disposed in spaced relation to the lower edge of the nozzle cone.

12. The valve element of claim 11 wherein the lower edge of the nozzle cone, the upper apex of the fracture ring, and the ribs collectively define a plurality of windows disposed within the valve body.

13. A valve element for integration into a nozzle assembly, the valve element comprising:

a generally conical valve body; and an elongate valve stem integrally connected to and extending axially from the valve body along a valve element axis;

wherein the valve body comprises:

a nozzle cone defining an outer surface and a bottom surface which is circumvented by a peripheral lower edge;

a hub integrally connected to the bottom surface of the nozzle cone;

at least one rib integrally connected to the hub and defining an outer end surface which is substantially continuous with the outer surface of the nozzle cone; and a fracture ring integrally connected to the rib and disposed in spaced relation to the nozzle cone, the fracture ring having an outer surface which is substantially continuous with the outer end surface of the rib.

14. The valve element of the claim 13 wherein the outer surface of the nozzle cone has a generally elliptical profile as it extends from the valve stem toward the lower edge.

15. The valve element of claim 13 wherein the hub has a generally quadrangular configuration, and four ribs are integrally connected to and protrude from respective ones of four corner regions defined by the hub.

16. The valve element of claim 15 wherein each of the ribs is further integrally connected to the bottom surface of the nozzle cone.

17. The valve element of claim 15 wherein each of the ribs has a generally wedge-shaped cross-sectional configuration and defines a lower apex which is directed away from the nozzle cone.

18. The valve element of claim 13 wherein the fracture ring has a generally wedge-shaped cross-sectional configuration and defines an upper apex which is directed toward and disposed in spaced relation to the lower edge of the nozzle cone.

19. The valve element of claim 18 wherein the lower edge of the nozzle cone, the upper apex of the fracture ring, and the ribs collectively define a plurality of windows disposed within the valve body.

20. A valve element for integration into a nozzle assembly, the valve element comprising:

a generally conical valve body; and an elongate valve stem integrally connected to and extending axially from the valve body along a valve element axis;

wherein the valve body comprises:

a nozzle cone defining an outer surface and a bottom surface which is circumvented by a peripheral lower edge;

a hub integrally connected to the bottom surface of the nozzle cone;

at least one rib integrally connected to the hub and defining an outer end surface which is separated from the lower edge of the nozzle cone by a step which is defined by a peripheral portion of the bottom surface of the nozzle cone; and a fracture ring integrally connected to the rib and disposed in spaced relation to the nozzle cone, the fracture ring having an outer surface which is substantially continuous with the outer end surface of the rib.

* * * * *